US005988464A

United States Patent [19]

Butler et al.

[11] Patent Number: 5,988,464

[45] Date of Patent: Nov. 23, 1999

[54] DRINK BOTTLE AND SUPPORT SYSTEM

[76] Inventors: Linda Green Butler, 4120 Phelan Rd., Phelan, Calif. 92371; Sammi J. Cimino, 268 W. 8th St., Upland, Calif. 91786

[21] Appl. No.: 09/138,388

[22] Filed: Aug. 24, 1998

[51] Int. Cl.[6] ..... A45F 3/16

[52] U.S. Cl. ..... 224/148.4; 224/674; 224/677; 224/901.8

[58] Field of Search ..... 224/901.8, 148.4, 224/148.5, 148.7, 665, 674, 677

[56] References Cited

U.S. PATENT DOCUMENTS

| | | | |
|---|---|---|---|
| 969,524 | 9/1910 | Condon | 224/674 |
| 1,605,195 | 11/1926 | Lewis | 224/674 |
| 4,418,733 | 12/1983 | Kallman | 224/901.8 |
| 4,690,316 | 9/1987 | Peterson | 224/901.8 |
| 4,867,358 | 9/1989 | Bennis | 224/148.7 |
| 5,048,734 | 9/1991 | Long | 224/148.4 |
| 5,240,156 | 8/1993 | Sicotte et al. | 224/148.7 |
| 5,325,991 | 7/1994 | Williams | 224/148.5 |
| 5,381,922 | 1/1995 | Gladman et al. | 224/901.8 |

*Primary Examiner*—Stephen P. Garbe

[57] ABSTRACT

A drink bottle and support system comprising a bottle having a closed lower end and an open upper end and a side wall therebetween. The side wall of the drink bottle having a generally cylindrical configuration on its exterior face, and an essentially flat configuration on its interior face. The bottle further having an interior and an exterior with insulation therebetween. The bottle also having external screw threads adjacent to its upper end. A cap for the bottle has internal threads coupleable to the threads of the bottle. A pile-type fastener in a rectangular configuration is adhesively secured to the flat face of the bottle. A pad in a rectangular configuration with a pile-type fastener is located over a majority of the extent of the front face of the pad for releasably receiving the pile-type fastener of the bottle. The pad has two belt loops on the interior face of the pad adjacent to the upper extent thereof.

6 Claims, 2 Drawing Sheets

DRINK BOTTLE AND SUPPORT SYSTEM

BACKGROUND OF THE INVENTION

1. Field of the Invention

The present invention relates to a new and improved drink bottle and support system and, more particularly, pertains to conveniently supporting a bottle on the body of a user.

2. Description of the Prior Art

The use of device bottles of known designs and configurations is known in the prior art. More specifically, bottles of known designs and configurations heretofore devised and utilized for the purpose of supporting bottles on a user through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for conveniently supporting a bottle on the body of a user. By way of example, U.S. Pat. No. 4,274,563 to Otterson, issued Jun. 23, 1981; U.S. Pat. No. 4,500,016 to Funfstuck, issued Feb. 19, 1985; U.S. Pat. No. 4,538,653 to Shea et al., issued Sep. 3, 1985; U.S. Pat. No. 4,560,092 to Souza, issued Dec. 24, 1985; U.S. Pat. No. 4,823,995 to Lewis, issued Apr. 24, 1989; and lastly, U.S. Pat. No. Des. 291,536 to Crawford et al., issued Aug. 25, 1987.

In this respect, the drink bottle and support system according to the present invention substantially departs from the conventional concepts and designs of the prior art, and in doing so provides an apparatus primarily developed for the purpose of conveniently supporting a bottle on the body of a user.

Therefore, it can be appreciated that there exists a continuing need for a new and improved drink bottle and support system which can be used for conveniently supporting a bottle on the body of a user. In this regard, the present invention substantially fulfills this need.

SUMMARY OF THE INVENTION

In view of the foregoing disadvantages inherent in the known types of bottles of known designs and configurations now present in the prior art, the present invention provides an improved drink bottle and support system. As such, the general purpose of the present invention, which will be described subsequently in greater detail, is to provide a new and improved drink bottle and support system and methods which have all the advantages of the prior art and none of the disadvantages.

To attain this, the present invention essentially comprises a new and improved drink bottle and support system comprising, in combination, a bottle having a closed lower end and an open upper end and a side wall therebetween, the side wall having a generally cylindrical configuration on its exterior face, and an essentially flat configuration on its interior face, the bottle having an interior and an exterior with insulation therebetween, the bottle having external screw threads adjacent to its upper end; a cap having interior threads coupleable to the threads of the bottle, the cap having a primary opening therethrough, the cap also having a cover rotatable in the cap with secondary openings rotatable over the primary opening for allowing a user to drink fluids from the bottle, the secondary opening rotatable away from the primary opening for retaining fluids within the bottle; a pile-type fastener in a rectangular configuration adhesively secured to the flat face of the bottle; a pad in a rectangular configuration with a pile-type fastener over a majority of the extent of the front face of the pad for releasably receiving the pile-type fastener of the bottle, the pad having two belt loops on the interior face of the pad adjacent to the upper extent thereof, the pad also having a pocket with a pile-type fastener for closing the pocket; and a belt with coupleable ends for securement to the waist of a user, the belt also having a flexible central extent for positioning through the loops of the pad for securing the pad to the user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drink bottle and support system which has all the advantages of the prior art bottles of known designs and configurations and none of the disadvantages.

It is another object of the present invention to provide a new and improved drink bottle and support system which may be easily and efficiently manufactured and marketed.

It is a further object of the present invention to provide a new and improved drink bottle and support system which is of a durable and reliable construction.

An even further object of the present invention is to provide a new and improved drink bottle and support system which is susceptible of a low cost of manufacture with regard to both materials and labor, and which accordingly is then susceptible of low prices of sale to the consuming public, thereby making such bottles of known designs and configurations economically available to the buying public.

Still yet another object of the present invention is to provide a new and improved drink bottle and support system which provides in the apparatuses and methods of the prior art some of the advantages thereof, while simultaneously overcoming some of the disadvantages normally associated therewith.

Even still another object of the present invention is to conveniently support a bottle on the body of a user.

Lastly, it is an object of the present invention to provide a drink bottle and support system comprising a bottle having a closed lower end and an open upper end and a side wall therebetween. The side wall of the drink bottle having a generally cylindrical configuration on its exterior face, and an essentially flat configuration on its interior face. The bottle further having an interior and an exterior with insulation therebetween. The bottle also having external screw threads adjacent to its upper end. A cap for the bottle h as internal threads coupleable to the threads of the bottle. A pile-type fastener in a rectangular configuration is adhesively secured to th e flat face of the bottle. A pad in a rectangular configuration with a pile-type fastener is located over a majority of the extent of the front face of the pad for releasably receiving the pile-type fastener of the bottle. The pad has two belt loops on the interior face of the pad adjacent to the upper extent thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
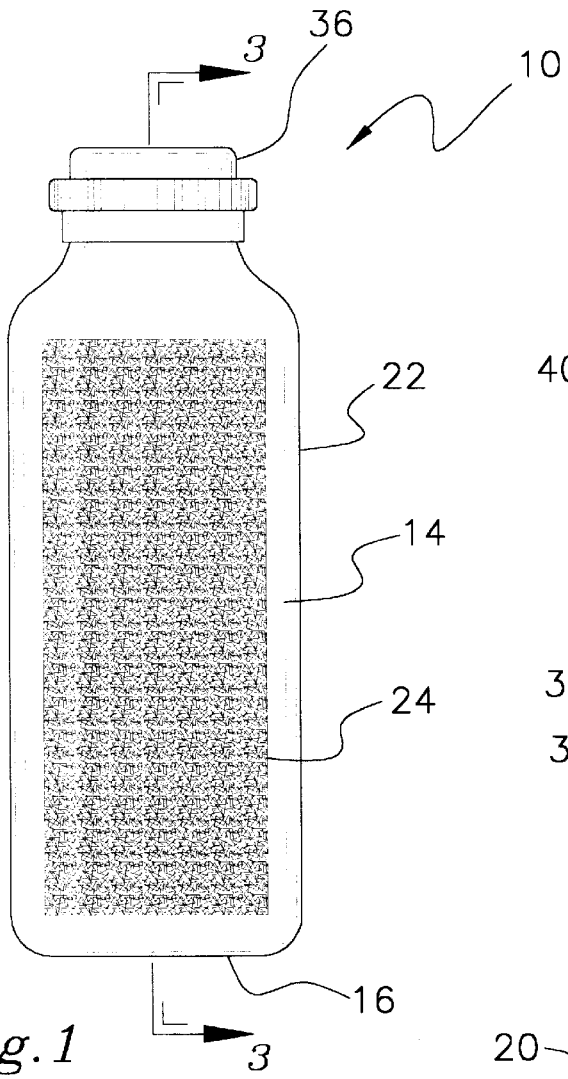
FIG. 1 is a rear elevational view of the bottle constructed in accordance with the principles of the present invention.
Figure 2:
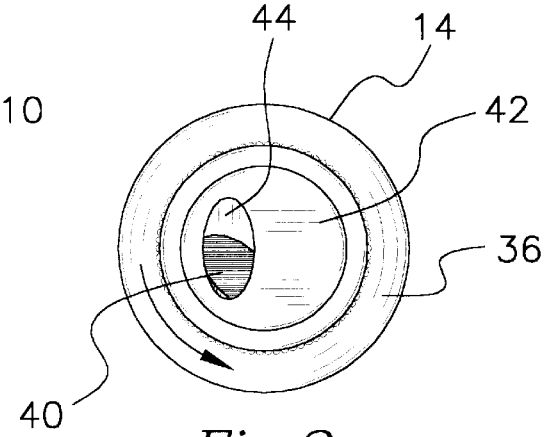
FIG. 2 is a top elevational view of the bottle shown in FIG. 1.
Figure 3:
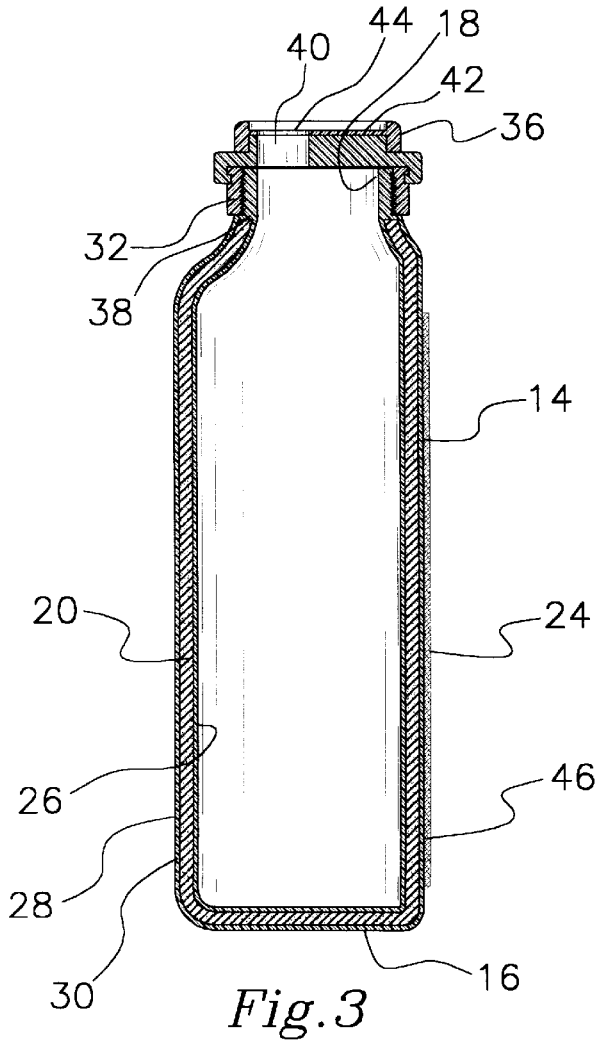
FIG. 3 is a cross-sectional view taken along line 3—3 of FIG. 1.
Figure 4:
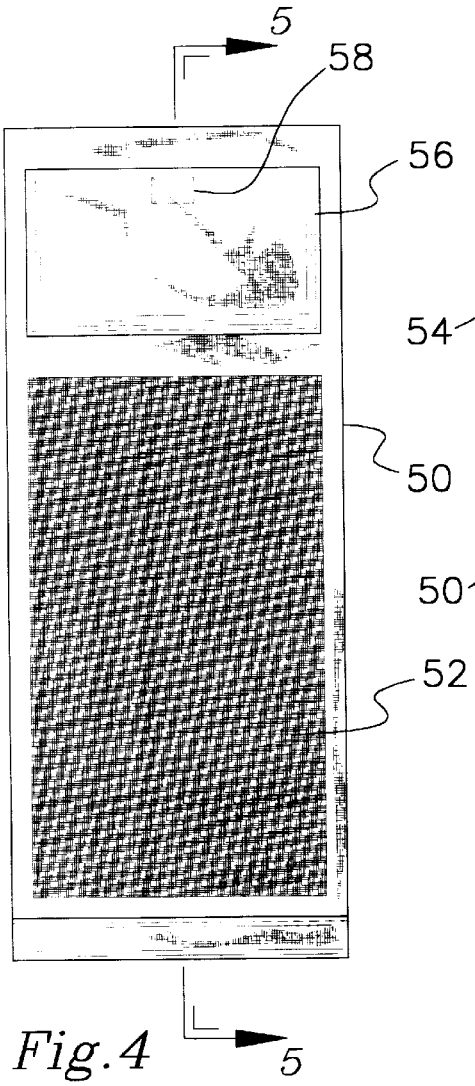
FIG. 4 is a front elevational view of the pad for use in association with the bottle of the prior figures.
Figure 5:
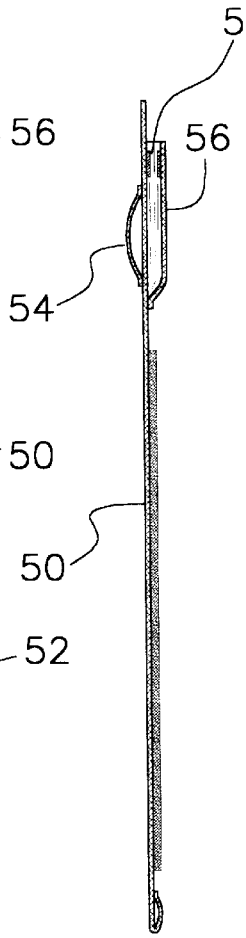
FIG. 5 is a cross-sectional view taken along line 5—5 of FIG. 4.
Figure 6:
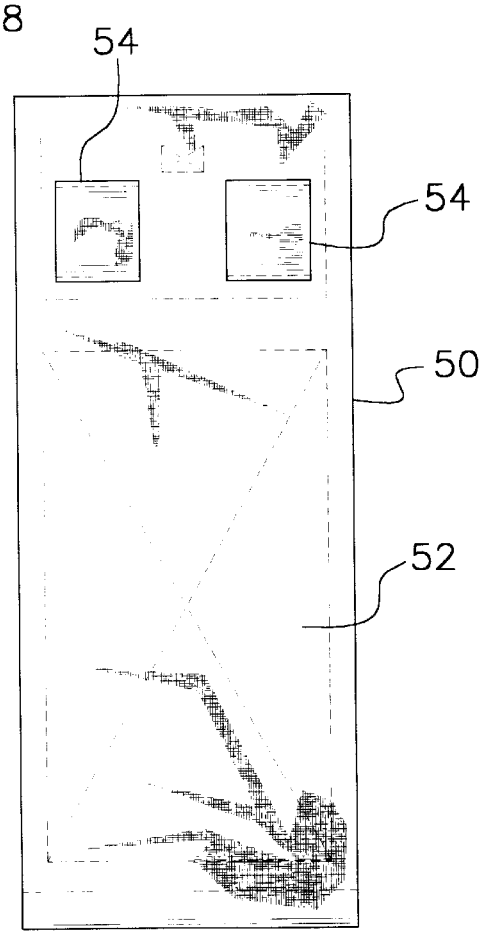
FIG. 6 is a rear elevational view of the pad shown in FIG. 4.

With reference now to the drawings, and in particular to FIG. 1 thereof, the preferred embodiment of the new and improved drink bottle and support system embodying the principles and concepts of the present invention and generally designated by the reference numeral 10 will be described.

The present invention, the new and improved drink bottle and support system is a system 10 comprised of a plurality of components. In their broadest context, the components include a bottle having a cap, a pile-type fastener, a pad, and a belt. Each of the individual components is specifically configured and correlated one with respect to the other so as to attain the desired objectives.

More specifically, the system 10 of the present invention includes a bottle 14 having a closed lower end 16 and an open upper end 18 and a side wall 20 therebetween. The exterior surface of the side wall has a generally curved face portion 22 and an essentially flat face portion 24. The bottle has an interior 26 and an exterior 28 with insulation 30 therebetween. Further, the bottle has external screw threads 32 adjacent to its upper end.

Next provided as a part of the system 10 is a cap 36. The cap has interior threads 38 coupleable to the threads of the bottle. The cap has a primary opening 40 therethrough. The cap also has a cover 42 rotatable in the cap with secondary openings 44 rotatable over the primary opening for allowing a user to drink fluids from the bottle. The secondary opening is rotatable away from the primary opening for retaining fluids within the bottle.

A pile-type fastener 46 is next provided. The pile-type fastener is in a rectangular configuration adhesively secured to the flat face of the bottle.

Next provided is a pad 50 in a rectangular configuration with a pile-type fastener 52 over a majority of the extent of its front face. The pad functions to releasably receive the pile-type fastener of the bottle. The pad has two belt loops 54 on the interior face of the pad adjacent to the upper extent thereof. The pad also has a pocket 56 with a pile-type fastener 58 for closing the pocket.

Lastly provided is a belt 62 with coupleable ends 64,66 for securement to the waist of a user. The belt also has a flexible central extent 68 for positioning through the loops of the pad for securing the pad to the user.

Figure 7:
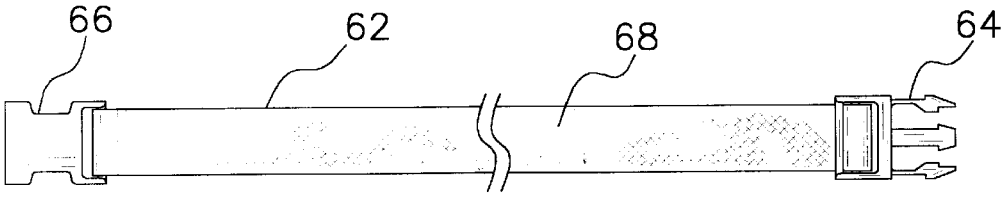
FIG. 7 is a front elevational view of a belt for coupling the pad to a user.
Figure 8:
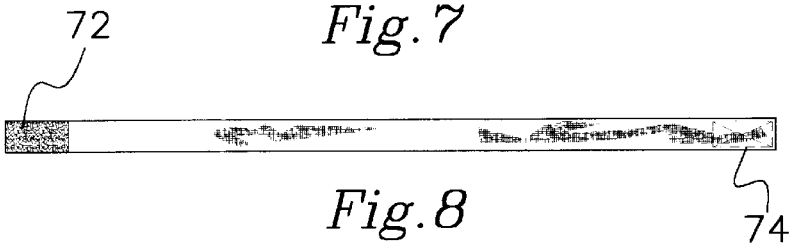
FIG. 8 is an alternate embodiment of the belt shown in FIG. 7.

In the embodiment of FIG. 7, the coupling ends 72,74 of the belt are shown with clips. In the FIG. 8 embodiment, the coupling ends are shown as pile-type fasteners 76,78.

The present invention is a specially designed drink bottle with a carrying holster that is convenient to carry for day trips, as for example, to amusement parks, sporting events or the like. The system consists of an insulated fluid holding container which features a flat back designed to ride comfortably against the leg of the user when carried on its holster. The container has a twist off lid that incorporates a twist-open-close, oval shaped opening for drinking. The main opening to the container is large enough to accept standard ice cubes. The insulating properties of the container are designed to retain the temperature of the contained liquid up to eight hours. The holster has an adjustable length waist belt. The closure system may be that of a standard three-prong buckle to support the weight of the drink. It may also employ a pile-type fastener.

At the bottom of the holster are straps to secure the holster to the leg of the user. These straps are also adjustable in length, and close for comfort when walking. The back of the fluid container and the front of the holster are covered with a commercial pile-type fastener to allow temporary holding of the drink container on the outside of the holster pocket.

The present invention can be offered in a variety of colors, and are suitable for imprint with logo or advertising for promotional purposes. One advantage of the present invention includes hands-free transport, whereby the weight is carried comfortably on the hip, not on the shoulder. The present invention may be produced in 8, 16, and 32 ounce sizes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved drink bottle and support system comprising, in combination:

a bottle having a closed lower end and an open upper end and a side wall therebetween, the exterior surface of the side wall having a generally curved face portion, and an essentially flat face portion, the bottle having an interior and an exterior with insulation therebetween, the bottle having external screw threads adjacent to its upper end;

a cap having interior threads coupleable to the threads of the bottle, the cap having a primary opening therethrough, the cap also having a cover rotatable in the cap with secondary openings rotatable over the primary opening for allowing a user to drink fluids from the bottle, the secondary opening rotatable away from the primary opening for retaining fluids within the bottle;

a pile-type fastener in a rectangular configuration adhesively secured to the flat face portion of the bottle;

a pad in a rectangular configuration with a pile-type fastener over a majority of the extent of the front face of the pad for releasably receiving the pile-type fastener of the bottle, the pad having two belt loops on the interior face of the pad adjacent to the upper extent thereof, the pad also having a pocket with a pile-type fastener for closing the pocket; and a belt with coupleable ends for securement to the waist of a user, the belt also having a flexible central extent for positioning through the loops of the pad for securing the pad to the user.

2. A drink bottle and support system comprising:

a bottle having a closed lower end and an open upper end and a side wall therebetween, the exterior surface of the side wall having a generally curved face portion, and an essentially flat face portion, the bottle having an interior and an exterior with insulation therebetween, the bottle having external screw threads adjacent to its upper end;

a cap having internal threads coupleable to the threads of the bottle;

a pile-type fastener in a rectangular configuration adhesively secured to the flat face portion of the bottle; and a pad in a rectangular configuration with a pile-type fastener over a majority of the extent of the front face of the pad for releasably receiving the pile-type fastener of the bottle, the pad having two belt loops on the interior face of the pad adjacent to the upper extent thereof.

3. The system as set forth in claim 2 and further including the cap having a primary opening therethrough, the cap also having a cover rotatable in the cap with secondary openings rotatable over the primary opening for allowing a user to drink fluids from the bottle, the secondary opening rotatable away from the primary opening for retaining fluids within the bottle.

4. The system as set forth in claim 2 and further including a belt with coupleable ends for securement to the waist of a user, the belt also having a flexible central extent for positioning through the loops of the pad for securing the pad to the user.

5. The apparatus as set forth in claim 4 wherein the coupling ends of the belt are clips.

6. The apparatus as set forth in claim 4 wherein the coupling ends of the belt are a pile-type fastener.

* * * * *